US007055703B2

(12) United States Patent
Perkins et al.

(10) Patent No.: US 7,055,703 B2
(45) **Date of Patent: *Jun. 6, 2006**

(54) SLOTWALL PANEL STORAGE SYSTEM

(75) Inventors: Travis Michael Perkins, Evansville, IN (US); Thomas Wesley Arent, St. Joseph, MI (US); Todd Christopher Starr, St. Joseph, MI (US); Tyree Edward Sampson, Gahanna, OH (US); Kenneth J. Rasche, Evansville, IN (US); Steven Edward Tolliver, Newburgh, IN (US); Brent A. Junge, Evansville, IN (US); Duane A. Schmidt, Newburgh, IN (US); Brian J. Stewart, Vincennes, IN (US); Mark Allen Stout, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/937,142

(22) Filed: Sep. 9, 2004

(65) Prior Publication Data

US 2005/0029210 A1 Feb. 10, 2005

Related U.S. Application Data

(63) Continuation of application No. 10/331,826, filed on Dec. 30, 2002, now Pat. No. 6,811,043.

(51) Int. Cl.
*A47F 5/08* (2006.01)

(52) U.S. Cl. ..... 211/94.01

(58) Field of Classification Search ..... 211/94.01, 211/87.01; D25/123, 138
See application file for complete search history.

(56) References Cited

U.S. PATENT DOCUMENTS

| | | | | | |
|---|---|---|---|---|---|
| 4,211,379 | A * | 7/1980 | Morgan et al. | ..... | 248/222.51 |
| 4,591,058 | A * | 5/1986 | Amstutz et al. | ..... | 211/94.01 |
| 4,607,753 | A * | 8/1986 | Radek | ..... | 211/94.01 |
| 4,615,448 | A * | 10/1986 | Johnstonbaugh | ..... | 211/94.01 |
| 4,700,849 | A * | 10/1987 | Wagner | ..... | 211/41.2 |
| 4,809,479 | A * | 3/1989 | Tierno et al. | ..... | 52/588.1 |
| 5,121,578 | A * | 6/1992 | Holz | ..... | 52/506.01 |
| 5,360,121 | A * | 11/1994 | Sothman | ..... | 211/87.01 |
| 5,412,912 | A * | 5/1995 | Alves | ..... | 52/36.5 |
| 5,711,115 | A * | 1/1998 | Wirt | ..... | 52/36.3 |
| 5,899,344 | A * | 5/1999 | Current et al. | ..... | 211/94.01 |
| 6,113,201 | A * | 9/2000 | Bauer | ..... | 312/245 |
| 6,134,846 | A * | 10/2000 | Lamb | ..... | 52/36.5 |
| 6,325,223 | B1 * | 12/2001 | Hannen | ..... | 211/87.01 |
| 6,393,877 | B1 * | 5/2002 | Church | ..... | 70/62 |
| 6,578,498 | B1 * | 6/2003 | Draudt et al. | ..... | 108/50.02 |
| 6,811,043 | B1 * | 11/2004 | Perkins et al. | ..... | 211/94.01 |

* cited by examiner

*Primary Examiner*—David Purol
(74) *Attorney, Agent, or Firm*—Stephen Krefman; Robert O. Rice; John F. Colligan

(57) ABSTRACT

A slotwall panel storage system has a slotwall panel with a plurality of generally "T" shaped slots forming a plurality of generally "T" shaped slats and a hanger bracket for removably mounting a device on the slotwall panel. The hanger bracket includes a support portion, a first generally "J" shaped hook on one edge of the support portion and a second generally "J" shaped hook on an opposite edge of the support portion. A hook or storage device is attached to the support portion of the hanger bracket.

18 Claims, 14 Drawing Sheets

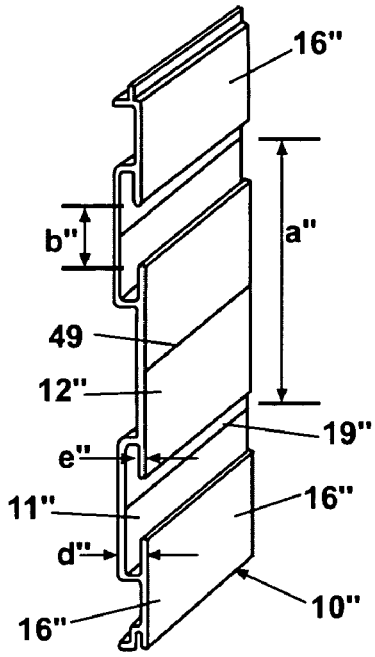
Fig. 17
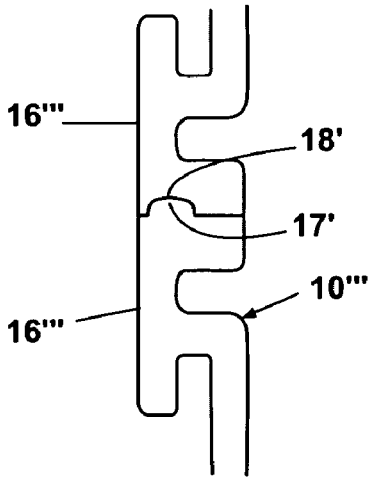
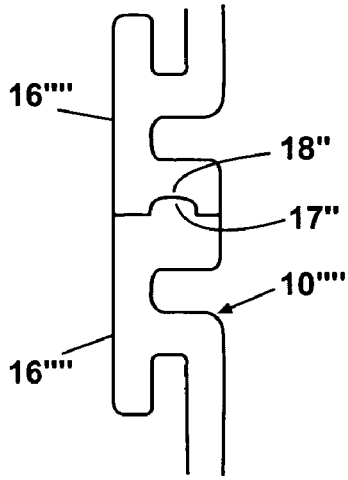
Fig. 18
Fig. 18A

SLOTWALL PANEL STORAGE SYSTEM

This patent application is a continuation of utility patent application Ser. No. 10/331,826, filed Dec. 30, 2002 now U.S. Pat. No. 6,811,043.

BACKGROUND OF THE INVENTION

Slotwall panels and corresponding brackets are well knows systems for mounting objects on walls or other surfaces. Typically, the slotwall panels comprise a plurality of horizontal mounting slats with slots between each slat, and the brackets are hung on the slats. The brackets are adapted to support a variety of objects ranging from tools in a workroom to products that are on display in a retail store. Because the brackets can usually be mounted anywhere on the slats, slotwall panel systems are versatile and can be used for a variety of purposes. There is a continuing need for improved slotwall panels and brackets that are aesthetically appealing, easy to use and install, and able to securely support large, heavy objects.

SUMMARY OF THE INVENTION

In one aspect, the invention relates to a slotwall panel storage system according to the invention comprises a slotwall panel having a plurality generally "T" shaped slots forming a plurality of generally "T" shaped slats having a face and having edges defined by said "T" shaped slots, said "T" shaped slots having a bottom wall generally parallel to and spaced inwardly from the face of said "T" shaped slats; and at least one bracket for removably mounting a device on said slotwall panel. The bracket comprises a support portion for attaching the device to said bracket; a first "J" shaped hook on one edge of said support portion opening in a first direction to hook into a first adjoining "T" shaped slot and over an edge of a slat; and a second "J" shaped hook on opposite edge of said support portion and opening in said first direction to hook into a second adjoining "T" shaped slot and behind an adjacent slat; wherein said first and second "J" shaped hooks can be simultaneously inserted into the first and second adjoining "T" shaped slots on said slotwall panel without pivoting said bracket.

Each of the first and second adjoining "T" shaped slots comprises an opening that is larger than said first and second "J" shaped hooks so that said at least one bracket can be mounted to said slotwall panel by inserting said first and second "J" shaped hooks into the first and second adjoining "T" shaped slots.

Each of said first and second "J" shaped hooks have a first leg extending in a direction generally perpendicular from the edge of said support portion and a second leg extending from said first leg in the first direction generally parallel to said support portion.

In one configuration, a plurality of brackets re used to support the device on said slotwall panel and at least two of plurality of brackets are horizontally spaced on said device for engaging the same slats.

In another configuration, a plurality of brackets are used to support the device on said slotwall panel and at least two of said plurality of brackets are vertically spaced on said device. Said device includes a housing, said plurality of brackets are attached to said housing with bolts, and said plurality of brackets extend a substantial portion of the width of said housing. At least one of the plurality of brackets is attached to the housing in a fixed position on said housing. Another of the plurality of brackets is adjustably attached to said housing such that the first "J" shaped hook of said another of the plurality of brackets can be adjusted relative to the housing to thereby rest on the slat. Said housing comprises holes sized for receiving said bolts for attaching said at least one of the plurality of brackets in a fixed position, and elongated slots for receiving said bolts for adjustably attaching said another of the plurality of brackets to the housing. Each of said plurality of brackets is attached to said housing with at least two bolts.

Said slotwall panel can be foamed plastic material. The slotwall panel can be extruded foamed material including polyvinyl chloride. Said slotwall panel can be wood with said "T" shaped slots formed by removing material to form said "T" shaped slats. Said slotwall panel can be a wood base with "T" shaped slots formed by attaching "T" shaped wood slats to the wood base. Said slotwall panel can be particle board with said "T" shaped slots formed by removing material to form said "T" shaped slats. Said slotwall panel can be a particle board base with said "T" shaped slots formed by attaching "T" shaped slats to the particle board base. Said slotwall panel can be plywood with said "T" shaped slots formed by removing material to form said "T" shaped slats. Said slotwall panel can be a plywood base with said "T" shaped slots formed by attaching "T" shaped slats to the plywood base. Said slotwall panel can be extruded aluminum.

BRIEF DESCRIPTION OF THE DRAWINGS

FIG. 17 is a partial perspective view of another embodiment of a slotwall panel.

FIG. 18 is a partial end view of another embodiment of a slotwall panel having the connecting rib and connecting groove in a different position on the edge of the slotwall panel.

FIG. 18A is a partial end view of another embodiment of a slotwall panel having the connecting rib and connecting groove in a different position on the edge of the slotwall panel.

DESCRIPTION OF THE INVENTION

In accordance with the present invention, a slotwall storage system incorporating a slotwall panel 10 having a plurality of generally "T" shaped slots 11 forming a plurality of generally "T" shaped slats 12 is provided with a hanger bracket for mounting a device on the slotwall panel. The slotwall panel can be formed of extruded polyvinyl chloride material. Co-pending U.S. patent application Ser. No. 10/747,421, filed Dec. 29, 2003, discloses one such material, which patent application is incorporated by reference. The slotwall storage system according to the present invention can be used in a residential garage to provide storage for outdoor tools and equipment. A variety of storage options can be provided as will be described below. The slotwall storage system can also be used in a workroom or workshop, or in commercial and industrial locations. The slotwall storage system can be used in conjunction with a Modular Workbench System as disclosed in co-pending patent application Ser. No. 10/334,078 filed Dec. 30, 2002, which application is incorporated by reference.

Figure 1:
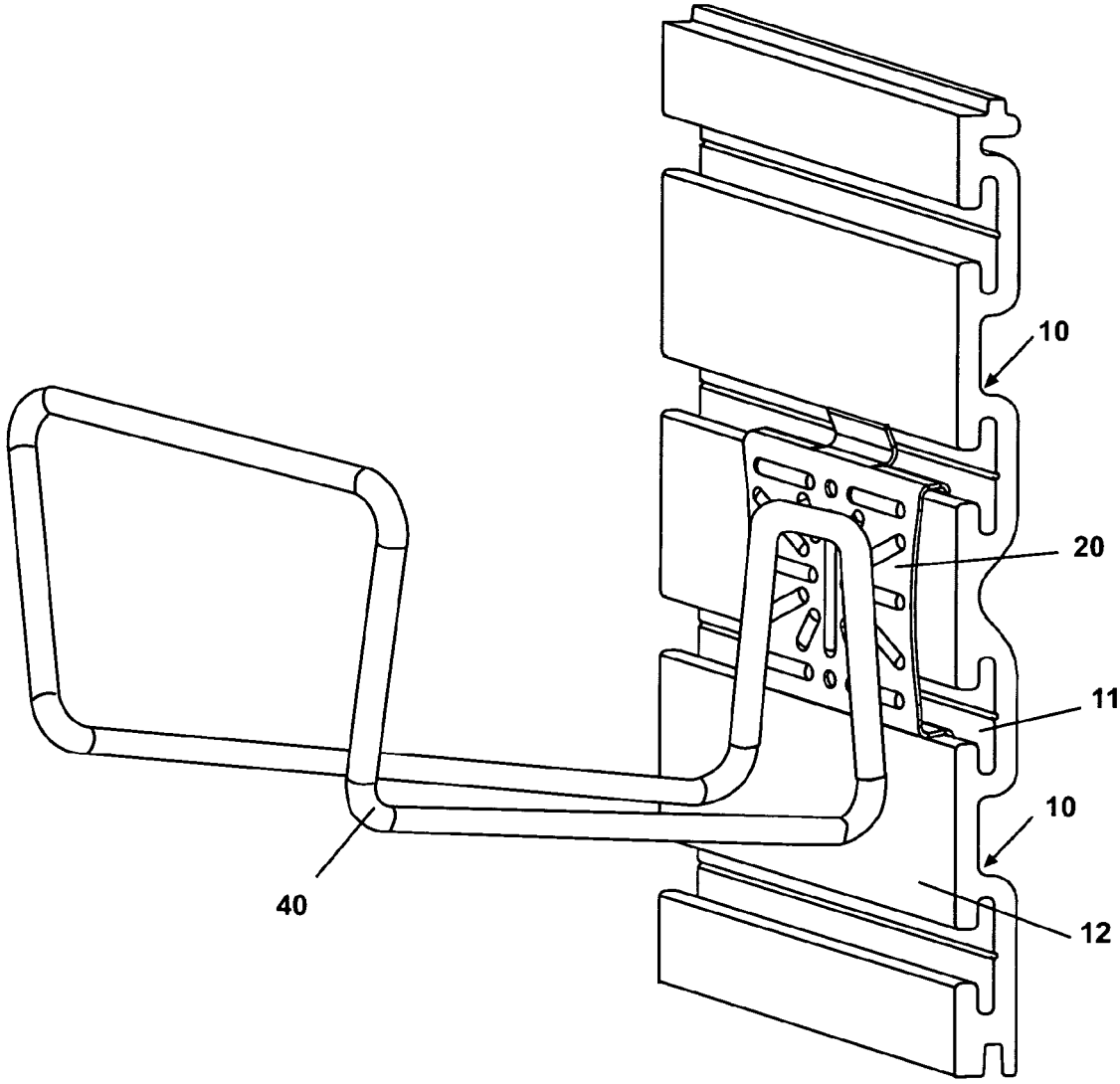
FIG. 1 is a partial perspective view of the slotwall storage system with a mounting device and hanger bracket mounted on a slotwall panel.
Figure 13:
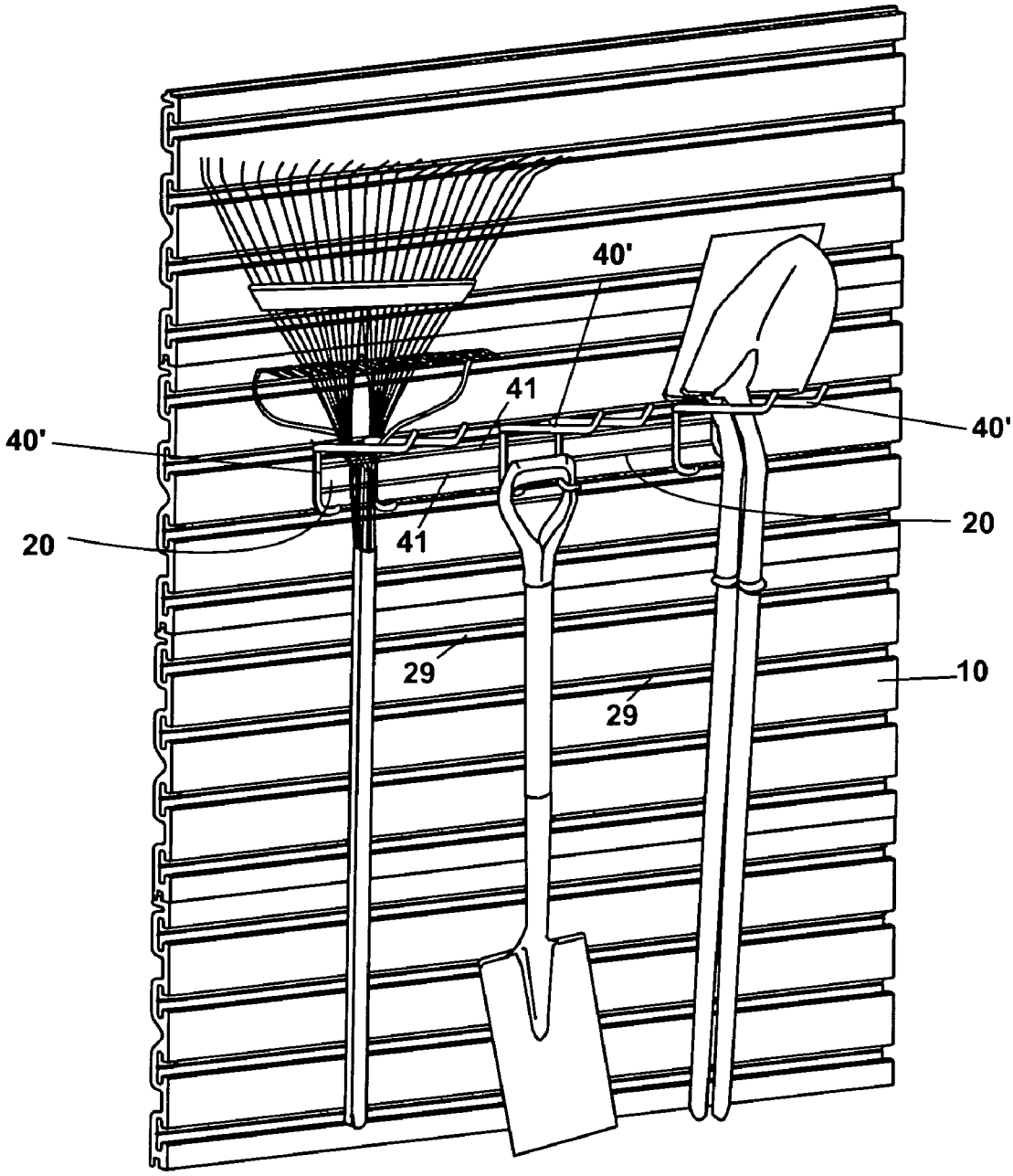
FIG. 13 is a perspective view of a multiple hook device mounted on a slotwall panel wall with plural hanger brackets and examples of tools carried on a multiple hook device.

Referring to FIG. 1, two slotwall panels 10 mounted adjacent one another are shown. It should be understood that the slotwall panels 10 shown in FIG. 1 are only a portion of such panels that can extend longitudinally for any desired length. Typically, slotwall panels can be extruded in 8 feet long lengths to facilitate handling and installation. However, it should be understood that panels longer or shorter that 8 feet can fabricated and used. Further, a single panel can be used or an entire wall can be covered with panels as shown in FIG. 13. One embodiment of a hanger bracket 20 is shown mounted on one of the panels 10 and is shown with one example of a hook device 40 attached to the hanger bracket 20. Other well known and available hooks and hanging devices can be attached to one or more hanger brackets 20 as will be understood by one skilled in the art. While a few examples of types of hook and other storage devices that can be attached to one or more hanger brackets are disclosed in this application, one skilled in the art will understand that there are many available hooks and storage devices available on the market that could be used with the brackets and slotwall panels according to this invention.

Figure 2:
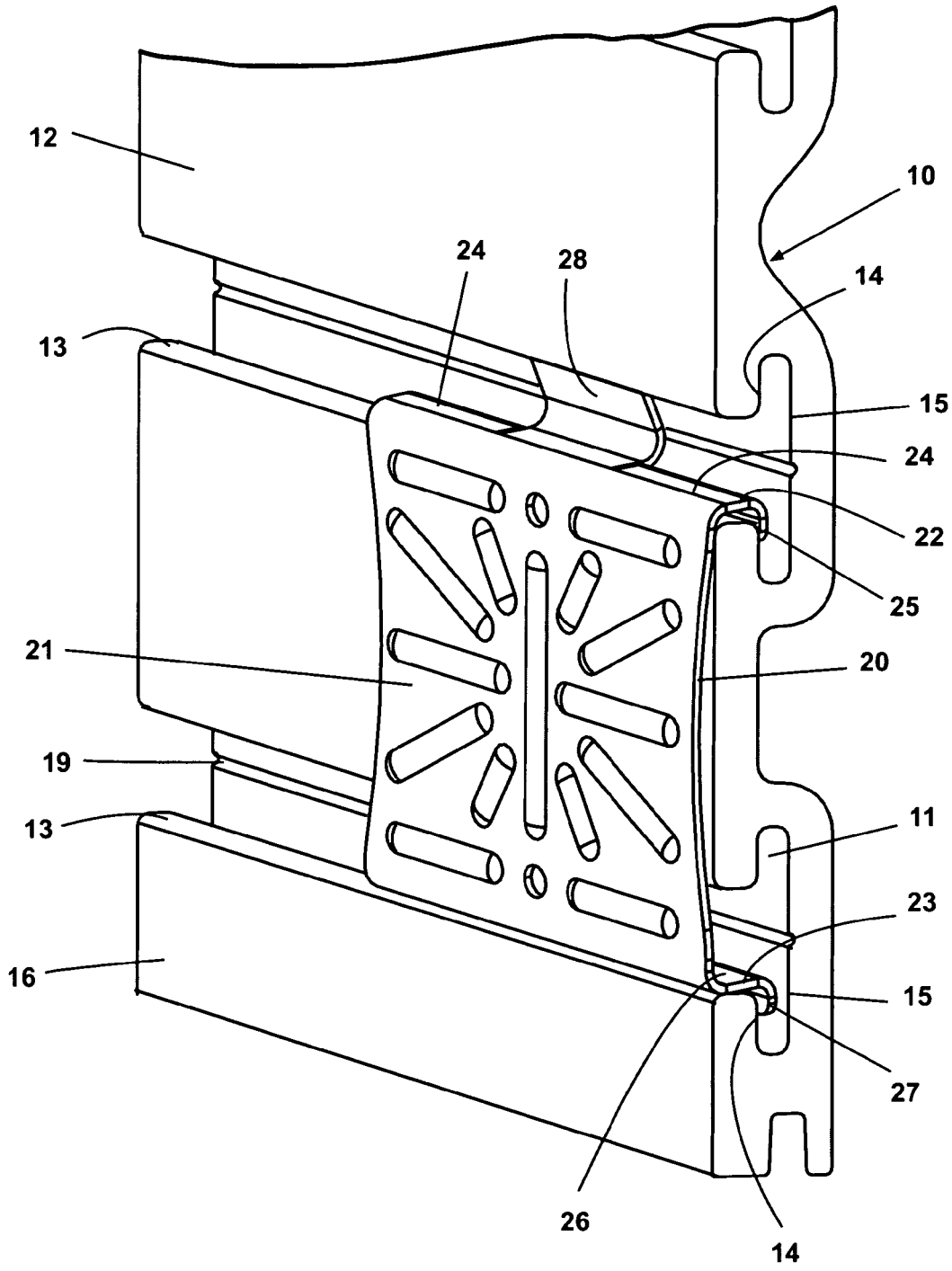
FIG. 2 is an enlarged perspective view of a portion of the slotwall panel with a hanger bracket mounted on the slotwall panel in a loaded position.
Figure 3:
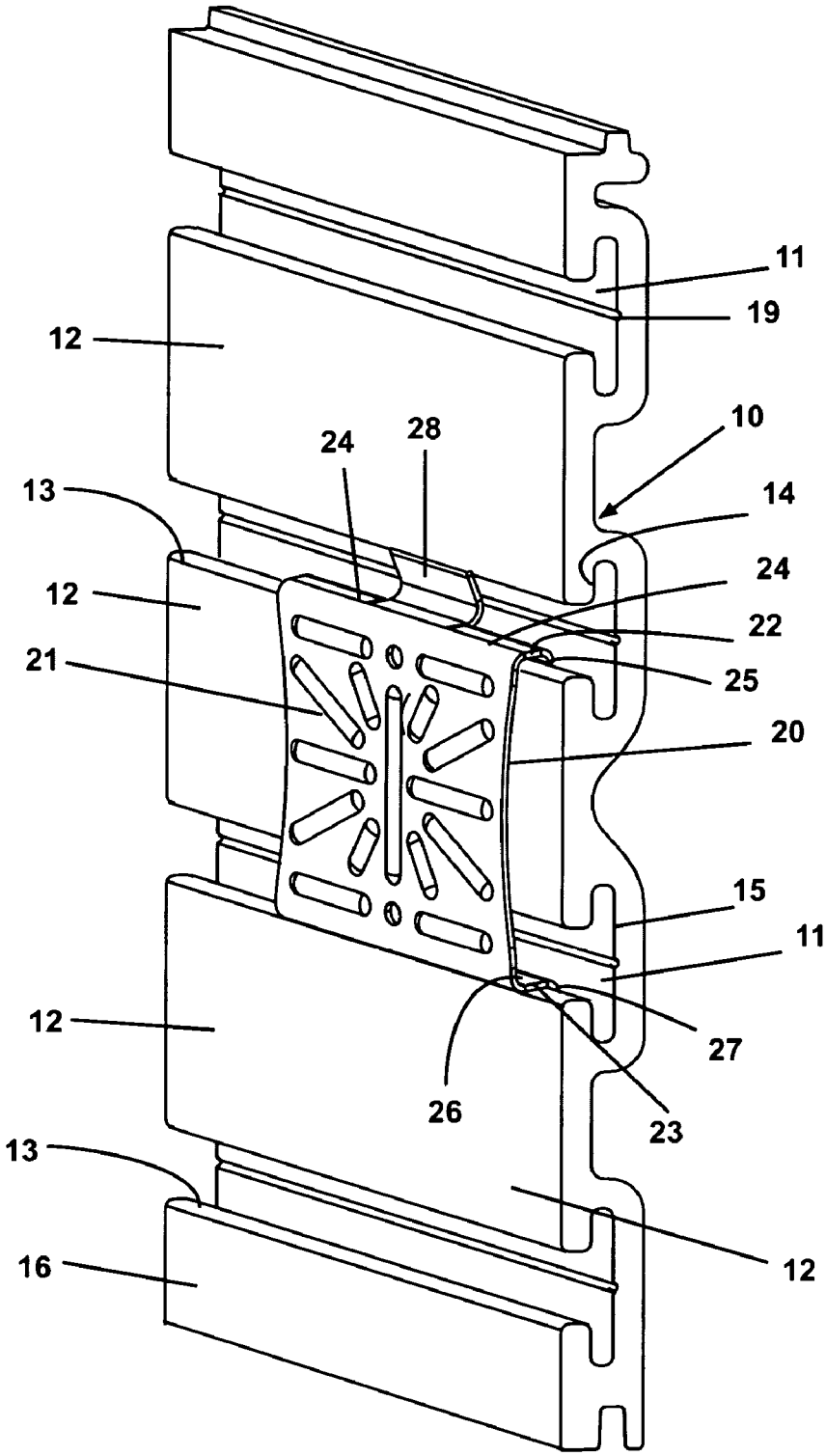
FIG. 3 is an enlarged perspective view of a portion of the slotwall panel with a hanger bracket mounted on the slotwall panel in an unloaded position.

Mounting of hanger bracket 20 to a slotwall panel 10 can be understood by referring to FIG. 2 and FIG. 3. In FIG. 2 and FIG. 3, a device 40 has been omitted from hanger bracket 20 to more clearly show hanger bracket 20 on the slotwall panel 10. Those skilled in the art will understand that in use a hook device or other storage device would be attached to hanger bracket 20. Hanger bracket 20 includes a central support portion 21, a generally "J" shaped hook 22 extending from one edge of support portion 21, and a generally "J" shaped hook 23 extending from an opposite edge of support portion 21. Generally "J" shaped hook 22 includes a first leg 24 extending generally perpendicular from the edge of support portion 21 and a second leg 25 extending from the distal end of first leg 24 generally parallel to support portion 21. Generally "J" shaped hook 23 has a first leg 26 extending generally perpendicular from the edge of support portion 21 and a second leg 27 extending from the distal end of first leg 26 generally parallel to support portion 21 in the same direction as leg 25. Thus, hanger bracket 20 has two downward opening "J" shaped hooks on opposite edges of support portion 21. Hanger bracket 20 also has a spring arm 28 extending from the edge of support portion 21 that divides generally "J" shaped hook 22 into two portions. Spring arm 28 extends in an opposite direction from leg 25. Referring to FIG. 2 and FIG. 3, generally "J" shaped hook 22 hooks over an edge 13 of a generally "T" shaped slat 12. Generally "J" shaped hook 23 hooks behind the lower adjacent half slat 16 in undercut 14. Spring arm 28 is positioned behind the upper adjacent slat 12 in undercut 14.

As shown in FIG. 3, leg 27 bears against the underside of the lower adjacent half slat 16 in undercut 14 biased against the underside of the slat by the spring arm 28. The force of spring arm 28 holds support portion 21 out of contact with the face of slat 12. Thus, hanger bracket 20 transfers the load on a device 40 through hanger bracket 20 to slotwall panel 10 by contact of leg 24 on edge 13 of slat 12, the contact of leg 25 against the inside edge of slat 12 and the force of spring arm 28 against the inside of the upper adjacent slat 12 in undercut 14. Leg 26 of "J" shaped hook 23 does not normally contact edge 13 of lower adjacent slat 12. Referring to FIG. 2, when a load is placed on device 40 that generates a moment sufficient to overcome the bias of spring arm 28, hanger bracket 20 pivots on "J" shaped hook 22 so that leg 27 engages the bottom wall 15 of "T" shaped slot 11. When hanger bracket 20 is loaded, hanger bracket 20 transfers the load on a device 40 through hanger bracket 20 to slotwall panel 10 by contact of leg 24 on edge 13 of slat 12, the contact of leg 25 against the inside edge of slat 12, the force of spring arm 28 against the inside of upper adjacent slat 12 in undercut 14 and by contact of leg 27 against bottom wall 15 of generally "T" shaped slot 11. The length of leg 26 holds hanger bracket 20 spaced from the face of slat 12 when hanger bracket 20 is loaded by items carried on device 40 so that leg 27 rests against the bottom wall 15 of slot 11. In the event hanger bracket 20 is overloaded by items placed on device 40, the pressure on leg 24 may be sufficient to deform the edge 13 of slat 12 allowing hanger bracket 20 to move down until leg 26 engages edge 13 of lower adjacent slat 12. In an overload condition, the load is spread over two adjacent slats 12 by generally "J" shaped hooks 22 and 23 in addition to the load spread by spring arm 28 to upper adjacent slat 12 and leg 27 to the bottom wall 15. Thus, hanger bracket 20 is locked in position on slotwall panel 10 by friction due to spring arm 28 whether loaded or unloaded. Accordingly, hanger bracket 20 and its attached device, whether loaded or unloaded, can not inadvertently be knocked off or dislodged from a slotwall panel 10.

Hanger bracket 20, together with any attached device such as device 40, can be mounted to a slotwall panel 10 by inserting spring arm 28 into the undercut 14 in a slot 11 far enough under the upper adjacent slat 12 for leg 25 to clear edge 13 of slat 12. Hanger bracket 20 can then be pivoted down against the moment of spring arm 28 until leg 27 clears the lower adjacent slat edge 13. Hanger bracket 20 can then be slid down over slat 12 until leg 25 rests on edge 13 with leg 27 bearing against the underside of the lower adjacent slat 12 in undercut 14. As mentioned above, hanger bracket 20 will be held in place by friction resulting from the moment of spring arm 28 bearing against the inside surface of the upper adjacent slat 12.

Figure 4:
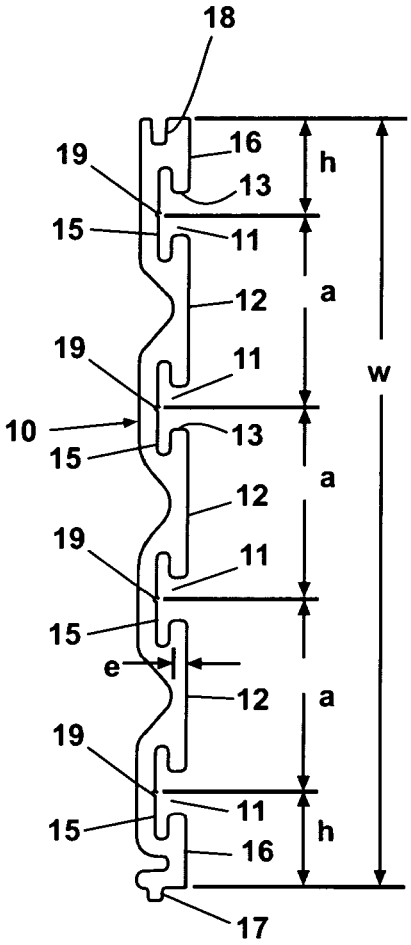
FIG. 4 is an end view of a slotwall panel showing the spacing of the generally "T" shaped slots.

Turning to FIG. 4, a slotwall panel 10 can include four generally "T" shaped slots 11 that form three generally "T" shaped slats 12 and two half slats 16, one on each edge of panel 10. One edge of slotwall panel 10 can include a projecting connecting rib 17 and the other edge can include a mating connecting groove 18. As shown in FIG. 1, rib 17 and connecting groove 18 connect adjacent panels and, when so joined, the half width slats 16 of the adjacent panels form a full width slat.

As shown in FIG. 1 and FIG. 4, the bottom wall 15 of the generally "T" shaped slots 11 includes a longitudinal alignment groove 19 in the center of bottom wall 15. Alignment groove 19 can facilitate mounting of slotwall panels on a wall. Alignment groove 19 can provide a locating function to allow screws or other mounting devices to be aligned along slotwall panel sections. In a wall installation, screws (not shown) can be driven through the slotwall panel along groove 19 into studs supporting the wall to mount the slotwall panel or panels to the wall as is well known to those skilled in the art. Mounting of plural slotwall panels is facilitated by connecting rib 17 and connecting groove 18 since another slotwall panel can be placed on a slotwall panel already attached to a wall and the slotwall panel will remain in place until fastened to the wall by screws or other suitable fasteners. Normally slotwall panels 10 can be mounted to a wall with connecting rib 17 directed up and connecting groove 18 directed down over rib 17 of an adjacent panel 10 if an adjacent panel is already mounted. Those skilled in the art will recognize that slotwall panels 10 can be mounted to a wall in the opposite direction if so desired, i.e. with rib 17 directed down and connecting groove 18 directed up. Applicants have found that locating the joint between adjacent slotwall panels in the center of a slat provides a stronger slotwall structure since torsional loads are minimal in the center of a slat as compared to joint locations in a slot or at an edge of a slat.

Figure 4A:
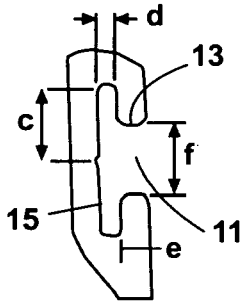
FIG. 4A is an enlarged end view of a portion of a slotwall panel showing the configuration of a generally "T" shaped slot.
Figure 4B:
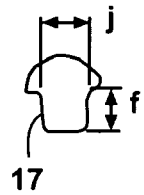
FIG. 4B is an enlarged end view of a portion of a slotwall panel showing the configuration of a connecting rib on the edge of a slotwall panel.
Figure 4C:
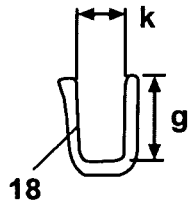
FIG. 4C is an enlarged end view of a portion of a slotwall panel showing the configuration of a connecting groove on the edge of a slotwall panel.
Figure 4D:
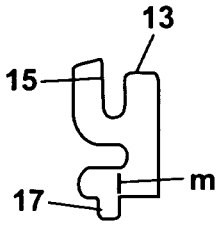
FIG. 4D is an enlarged end view of a portion of a slotwall panel showing the location of a connecting rib on the edge of a slotwall panel.
Figure 4E:
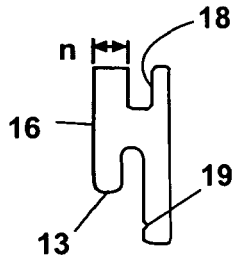
FIG. 4E is an enlarged end view of a portion of a slotwall panel showing the location of a connecting groove on the edge of a slotwall panel.

Referring to FIG. 4 through FIG. 4E, the dimensions of one embodiment of a slotwall panel 10 can be as provided in the following table. It should be understood that the following dimensions are approximate and that slotwall panels having different dimensions can be provided in accordance with the invention as desired.

| Description | Reference | Dimension (mm) |
|---|---|---|
| Width of slotwall panel 10 | w | 305 |
| Center to center of "T" shaped slots 11 | a | 76.2 |
| Width of "T" shaped slot opening | b | 17 |
| Center of slot to end of undercut 14 | c | 18.5 |
| Depth of undercut 14 | d | 5 |
| Thickness of slat 12 | e | 7 |
| Length of rib 17 | f | 5 |
| Depth of groove 18 | g | 10 |
| Center of slot 11 to edge of panel 10 | h | 38.1 |
| Width of rib 17 | j | 5.75 |
| Width of groove 18 | k | 6 |
| Rib 17 to face of anel 10 | m | 9 |
| Groove 18 to face of panel 10 | n | 9 |

Figure 5:
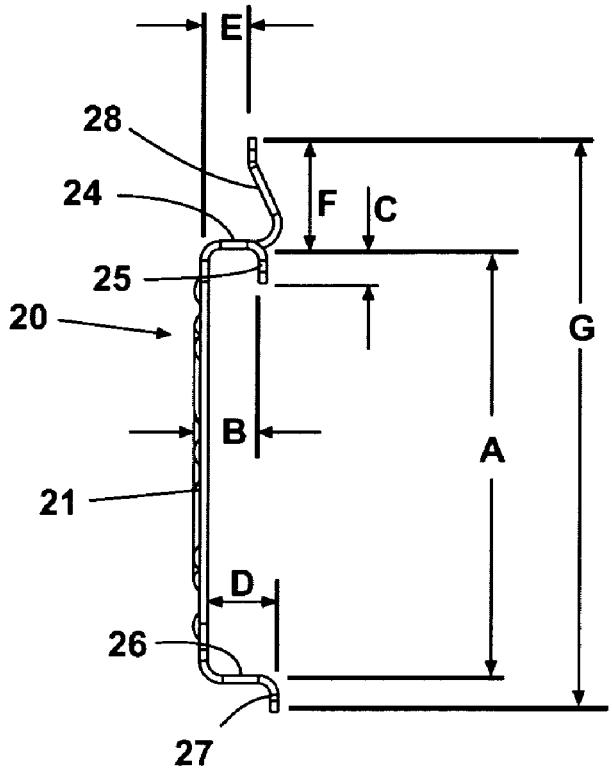
FIG. 5 is an end view of a hanger bracket showing the configuration of the generally "J" shaped hooks.
Figure 6A:
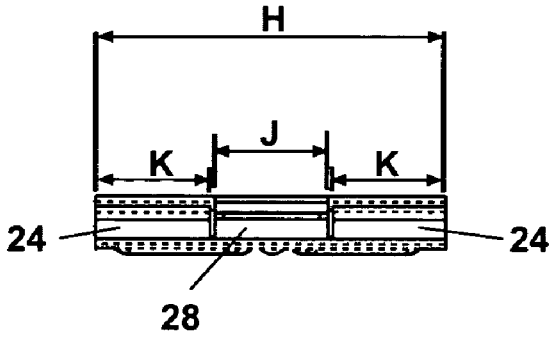
FIG. 6A is a top view of a hanger bracket showing the configuration of the spring arm and the generally "J" shaped hook adjacent the spring arm.
Figure 6B:
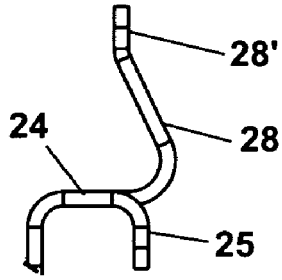
FIG. 6B is an end view of an enlarged end view of a portion of a hanger bracket showing the spring arm configuration.

Referring to FIG. 5, FIG. 6A and FIG. 6B, the dimensions of one embodiment of a hanger bracket 20 adapted for use with a slotwall panel as shown in FIG. 4 through FIG. 4E can be as provided in the following table. It will be appreciated by those skilled in the art that the following dimensions are approximate and that a hanger bracket having different dimensions can be provided in accordance with the invention as desired for use with slotwall panels having different dimensions.

| Description | Reference | Dimension (mm) |
|---|---|---|
| Distance from "J" hook 22 to "J" hook 23 | A | 75.2 |
| Inside length of leg 24 | B | 8.5 |
| Inside length of leg 25 | C | 6 |
| Outside length of leg 26 | D | 12.1 |
| Offset of spring arm 28 from face of bracket | E | 6.6 |
| Distance to top of spring arm 28 from leg 24 | F | 19 |
| Overall length of bracket 20 | G | 99 |
| Overall width of bracket 20 | H | 80 |
| Width of spring arm 28 | J | 26 |
| Width of leg 24 | K | 26 |

Hanger bracket 20 can be formed of metal, such as steel. When hanger bracket 20 is formed with steel, hanger bracket 20 can be stamped from sheet steel. When hanger brackets 20 are formed of steel, raised surfaces or bosses 44, as shown in FIGS. 2 and 3, can be stamped in support portion 21 to provide attachment points for hook devices to be welded to the hanger bracket. After a hook device is attached to hanger bracket 20, the hanger bracket can be finished as desired, such as by painting the entire hanger bracket and hook.

Referring to FIG. 6B, spring arm 28 can extend up from first leg 24 at an acute angle of approximately 65°. As also shown in FIG. 6B, the distal end 28' of spring arm 28 can be bent to extend generally parallel to support portion 21 and leg 25. Referring to the embodiment shown in FIG. 4 through FIG. 4E, FIG. 5, and FIG. 6B, the function of spring arm 28 can be seen. The thickness e of a generally "T" shaped slat can be 7.0 mm and the offset E of spring arm 28 can be 6.6 mm. When a hanger bracket 20 is installed on a slotwall panel 10 with spring arm 28 positioned behind an adjacent generally "T" shaped slat in undercut 14 and generally "J" shaped hook 22 is hooked over an edge 13 of a generally "T" shaped slat, interference of the distal end of the spring arm 28 with the inside of the adjacent "T" shaped slat will tend to rotate hanger bracket 20 away from the face of slotwall panel 10. When generally "J" shaped hook 22 is hooked over and engages an edge 13 of a generally "T" shaped slat 12, hook 23 will be positioned adjacent edge 13 of a lower adjacent generally "T" shaped slat 12. Leg 27 will be positioned behind the lower adjacent generally "T" shaped slat 12 in undercut 14. The moment produced by spring arm 28 pressing against the inside of upper adjacent "T" shaped slat 12 will drive leg 27 into contact with the inner surface of lower adjacent generally "T" shaped slat 12 thus friction locking hanger bracket 20 in place. When a device such as a hook device 40 is attached to support portion and a load is placed on the hook device, the downward force on the hook device will drive hanger bracket 20 toward slotwall panel 10 until leg 27 engages the bottom wall 15 of the generally "T" shaped slot 11. The length D of leg 26 can be 12.1 mm and can be slightly greater than the width d of undercut 14 which can be 5.0 mm plus the thickness e of slat 12 which can be 7.0 mm. Thus, hanger bracket 20 can be held out of contact with the face of slat 12 over which it is installed, whether loaded or unloaded. The distance A from the inside of first leg 24 of "J" shaped hook 22 to the inside of first let 26 of "J" shaped hook 23 can be 75.2 mm compared to the center to center spacing a of slots and slats which can be 76.2 mm. When hanger bracket 20 is installed on a generally "T" shaped slat 12 with leg 24 of "J" shaped hook 22 engaging an edge 13, leg 26 of "J" shaped hook 23 will not engage edge 13 of adjacent slat 12. Thus, hanger bracket 20 can pivot between the position shown in FIG. 2 to the position shown in FIG. 3 as a load is applied to hanger bracket 20 by an attached hook device such as 40.

Figure 7:
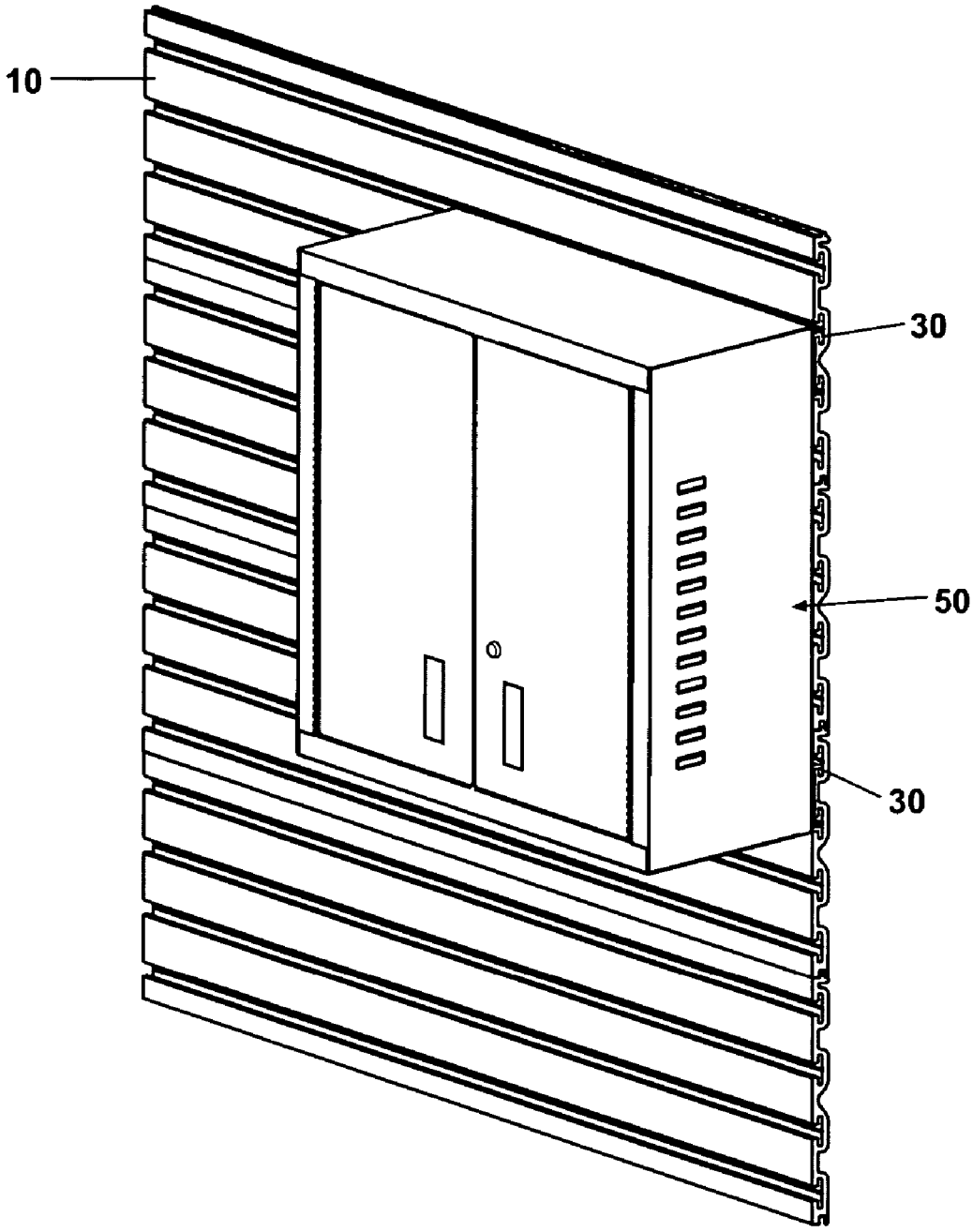
FIG. 7 is a partial front perspective view of a cabinet having plural cabinet brackets mounted on a slotwall panel.
Figure 8:
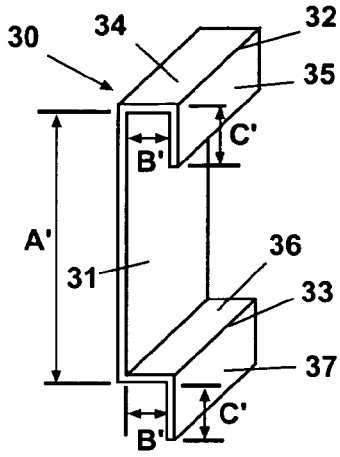
FIG. 8 is a perspective view of a cabinet bracket showing two generally "J" shaped hooks and the configuration of the cabinet bracket.
Figure 8A:
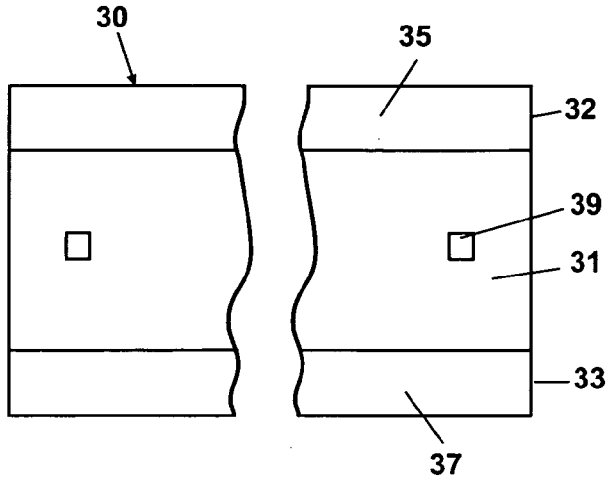
FIG. 8A is a partial front view of a cabinet bracket showing mounting holes.

Referring to FIG. 7, FIG. 8 and FIG. 8A, a cabinet 50 is shown mounted on a slotwall panel 10. Cabinet 50 can be provided with another embodiment of hanger brackets mounted to one wall of cabinet 50. Cabinet brackets 30 can extend generally the full width of cabinet 50. Alternately, cabinet brackets 30 can extend less than the full width of cabinet 50 and multiple cabinet brackets 30 can be installed across the width of cabinet 50. Cabinet bracket 30 can include a support portion 31 for mounting the cabinet bracket 30 to a cabinet 50. A generally "J" shaped hook 32 can be provided on one edge of support portion 31. Another generally "J" shaped hook 33 can be provided on an opposite edge of support portion 31. Generally "J" shaped hook 32 can include a first leg 34 extending generally perpendicular to support portion 31 and a second leg 35 extending from the distal end of first leg 34 generally parallel to support portion 31. Generally "J" shaped hook 33 can include a first leg 36 extending generally perpendicular to support portion 31 and a second leg 37 extending from the distal end of first leg 36 generally parallel to support 31 and in the same direction as second leg 35. Cabinet brackets 30 can be dimensioned so that a cabinet bracket can be mounted to a slotwall panel without tipping the cabinet bracket 30. In order to mount a cabinet bracket without tipping the cabinet bracket 30, the length of second legs 35 and 37 should be less than width b the opening of "T" slots 11 in FIG. 4A. Similarly, the spacing of generally "J" shaped hooks 32 and 33 should correspond to center to center dimension a of the generally "T" shaped slots in FIG. 4.

Referring to FIG. 8, the dimensions of one embodiment of a cabinet hanger bracket 30 adapted for use with a slotwall panel, as shown in FIG. 4 through FIG. 4F, can be as provided in the following table. It will be appreciated by those skilled in the art that the following dimensions are approximate and that cabinet brackets having different dimensions can be provided in accordance with the invention as desired for use with slotwall panels having different dimensions.

| Description | Reference | Dimension (mm) |
|---|---|---|
| Distance from "J" hook 32 to "J" hook 33 | A' | 75.2 |
| Inside length of leg 34 and 36 | B' | 8.5 |
| Inside length of leg 35 and 37 | C' | 6 |

Cabinet brackets 30 can be formed of metal. Cabinet bracket 30, as shown in FIG. 8, can be formed of extruded aluminum cut to lengths corresponding to the width of the cabinet or device to which the particular cabinet bracket will be attached.

As with the case of hanger bracket 20, cabinet bracket 30 can have a dimension A' from the inside of generally "J" shaped hook 32 to the inside of generally "J" shaped hook 33 that is slightly less than the center to center dimension a of the slotwall panel in FIG. 4. When dimension A' is slightly less than the center to center dimension a of slotwall panel, the load on cabinet bracket 30 produced by cabinet 50 will be on generally "J" shaped hook 32 and first leg 34 engaging edge 13 of generally "T" shaped slat 12. Because generally "J" shaped hook 32 engages an edge 13 of a generally "T" shaped slat 12 before generally "J" shaped hook 33, cabinet bracket 30 is held parallel to slotwall panel 10 and does not tip out at the top.

Figure 9:
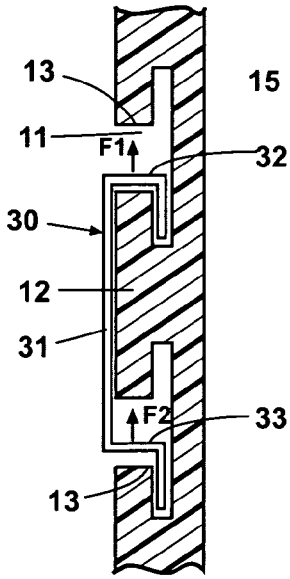
FIG. 9 is a schematic side view of an unloaded cabinet bracket mounted on a slotwall panel.
Figure 10:
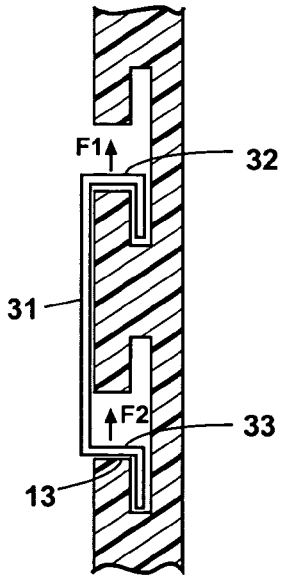
FIG. 10 is a schematic side view of a loaded cabinet bracket mounted on a slotwall panel.
Figure 11:
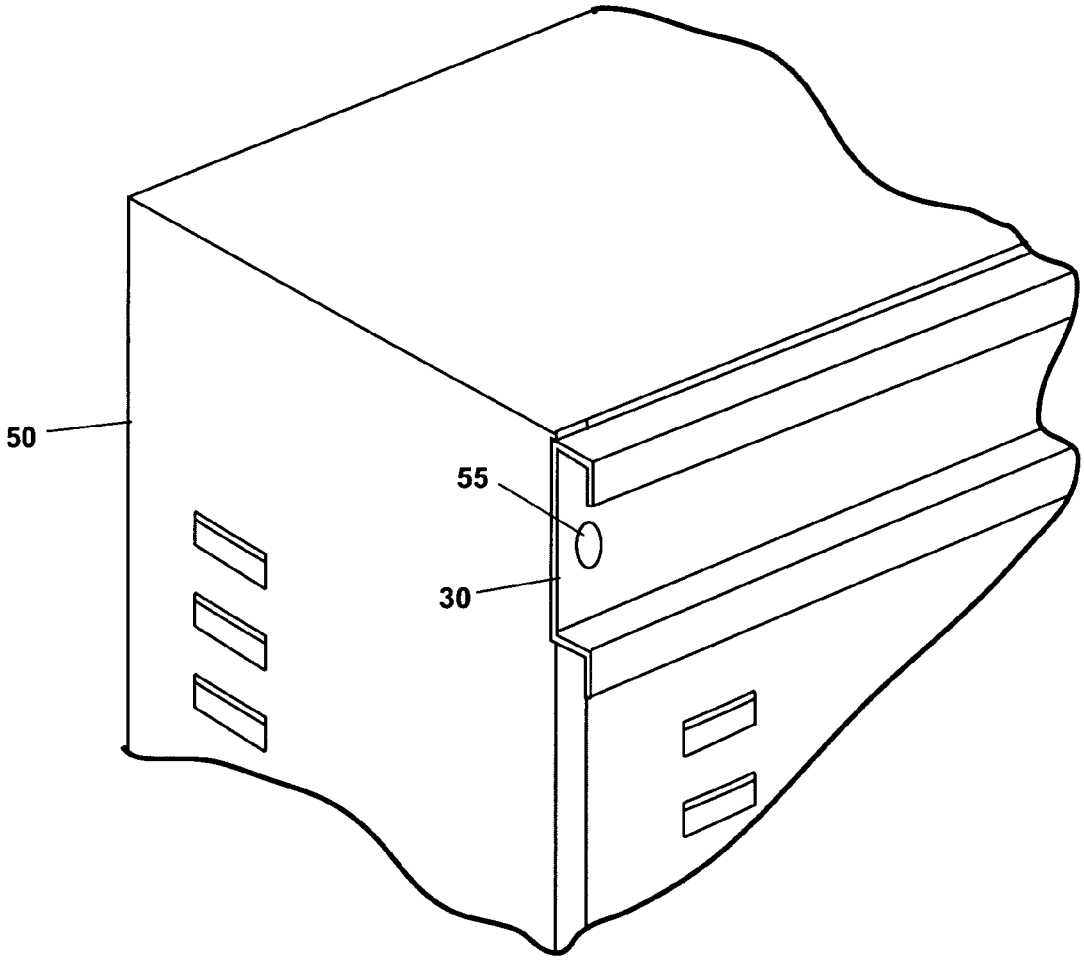
FIG. 11 is a partial rear perspective view showing a cabinet bracket mounted on a cabinet.
Figure 11A:
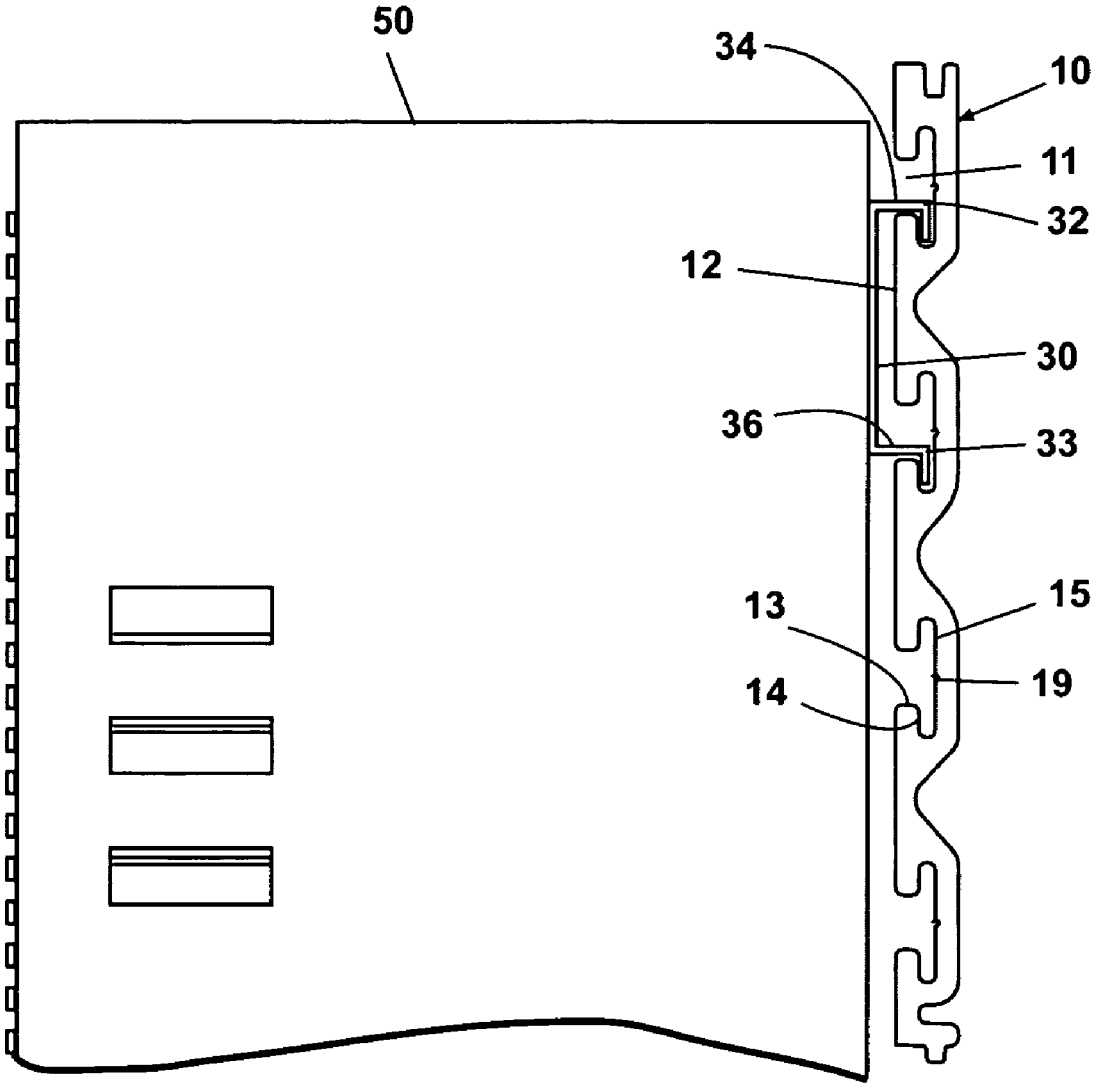
FIG. 11A is an end view showing a wall cabinet mounted on a slotwall panel.
Figure 12:
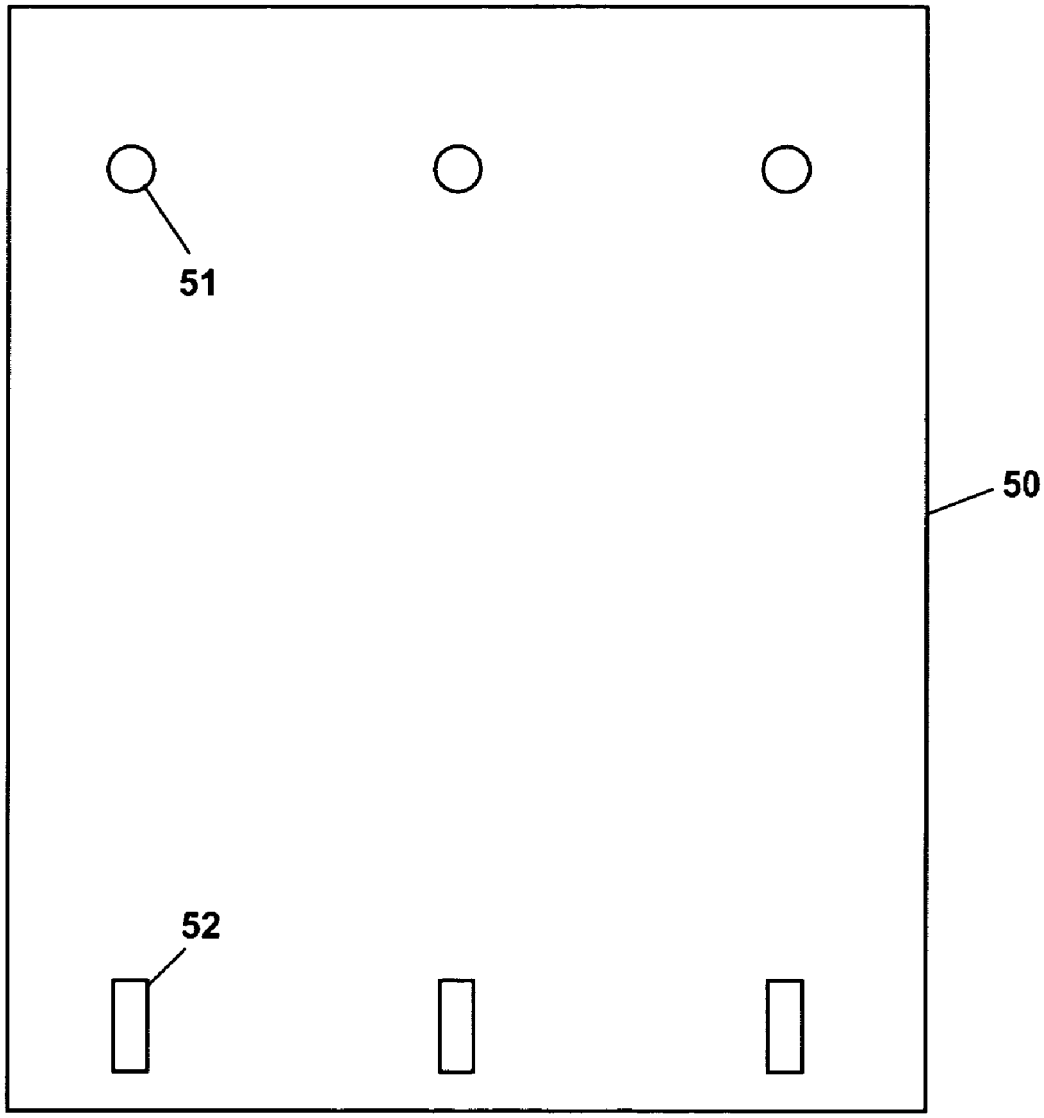
FIG. 12 is a rear elevation view of a cabinet showing mounting holes for cabinet brackets.

Referring to FIG. 9 and FIG. 10, the operation of cabinet brackets 30 can be seen. As the load on cabinet bracket 30 is increased by the load placed in cabinet 50, the edge 13 of slat 12 under generally "J" shaped hook 32 deforms allowing generally "T" shaped hook 33 to engage edge 13 of adjacent slat 12 thus increasing support for the cabinet bracket. Thus, cabinet brackets 30 initially transfer the load of cabinet 50 through generally "J" shaped hook 32 to the slotwall panel 10 by engagement of leg 34 with edge 13 of a generally "T" shaped slat 12. Generally "J" shaped hook 33 only engages the lower adjacent generally "T" shaped slat 12 when the load in cabinet 50 is sufficient to deform edge 13 of slat 12 on which leg 34 is resting.

Referring again to FIG. 8A, FIG. 11, FIG. 11A and FIG. 12 a plurality of square holes 39 can be provided in cabinet bracket 30 for mounting cabinet bracket 30 to cabinet 50. Cabinet 50 can be provided with a plurality of mounting holes 51 adjacent the top of cabinet 50 for a top cabinet bracket spaced to correspond to the spacing of mounting holes 39 in cabinet bracket 30. Mounting holes 51 can be round to permit mounting of a top cabinet bracket 30 in a fixed position adjacent the top of cabinet 50. One or more additional rows of mounting holes 52 can be provided below mounting holes 51 to allow mounting of one or more lower cabinet brackets 30. Mounting holes 52 can be vertically elongated slots to permit vertical adjustment of the lower cabinet brackets to insure that each cabinet bracket upper generally "J" shaped hook 32 engages a slat edge 13.

In order to install a cabinet 50 on a slotwall panel, a top cabinet bracket can be attached to cabinet 50 utilizing a plurality of mounting bolts 55 inserted with the head in cabinet bracket 30 and the threaded portion projecting through mounting holes 51 into cabinet 50. Mounting bolts can be a carriage bolt or similar fastening device that can be tightened without access to the head. Suitable fasteners, not shown, can be threaded on mounting bolts 55 and tightened to secure top cabinet bracket 30 to cabinet 50. Next, one or more lower cabinet brackets can be attached to cabinet 50 utilizing a plurality of mounting bolts 55 inserted with the head in cabinet bracket 30 and the threaded portion projecting through vertical slot mounting holes 52 into cabinet 50. Suitable fasteners, not shown, can be threaded on mounting bolts 55 and left loose to permit adjustment of the position of the one or more cabinet brackets 30 on cabinet 50 relative to the slotwall panel 10. Cabinet 50 can then be mounted on slotwall panels that have been mounted or attached to a wall structure. The top cabinet bracket 30 is first hooked on a selected slotwall panel slat 12 with leg 34 engaging a slat edge 13. Next, the lower cabinet bracket or brackets 30 are vertically adjusted so that each generally "J" shaped hook 32 engages a slotwall panel slat 12 with leg 34 engaging a slat edge 13. After the one or more lower cabinet brackets 30 are all positioned hooked over a slotwall panel slat 12 with leg 34 engaging a slat edge 13 the fasteners can be tightened securing the one or more cabinet brackets to the cabinet 50. As mentioned above, the vertically elongated mounting holes provide sufficient vertical adjustment to allow multiple cabinet brackets to be employed for mounting a cabinet to a plurality of slotwall panels 10 with each cabinet bracket transferring load from the cabinet 50 to the slotwall panel to spread the load in cabinet 50 across multiple slotwall panels 10 and slats 12.

Referring to FIG. 13, hanger brackets 20 can be combined to support plural mounting hooks 40'. FIG. 13 also illustrates yard tools carried on the mounting hooks on a slotwall storage system occupying a section of a wall. The slotwall panels 10 can be fastened to a wall using a plurality of fasteners, such as screws. A plurality of screws is fastened through the slotwall panels 10 in each slot 11 spaced apart by the distance between underlying studs or wall support structures. Those skilled in the art will understand that fasteners can be used in alternate generally "T" shaped slots 11, or other patterns as desired depending on the anticipated loading on the slotwall panels 10. Likewise, fasteners could be driven into alternate studs or wall supports. The specific mounting hooks shown and the yard tools carried are only examples to show how the slotwall storage system can be used. Those skilled in the art will understand that many other hooks or storage devices could be attached to one or more hanger brackets to store any desired objects. In the embodiment of FIG. 13, two hanger brackets can be connected with a pair of connecting rods 41 to which three mounting hooks 40' are attached. The connecting rods can be welded to hanger brackets 20 and mounting hooks 40' can be welded to connecting rods 41. The combined mounting hook device can be mounted on a slotwall panel 10 in the same manner as a single hanger bracket as described above. Those skilled in the art will recognize that the combined mounting hook device shown in the embodiment of FIG. 13 is only one possible arrangement of multiple mounting hooks and that more or less than three mounting hooks could be attached to two or more connected hanger brackets.

Figure 14:
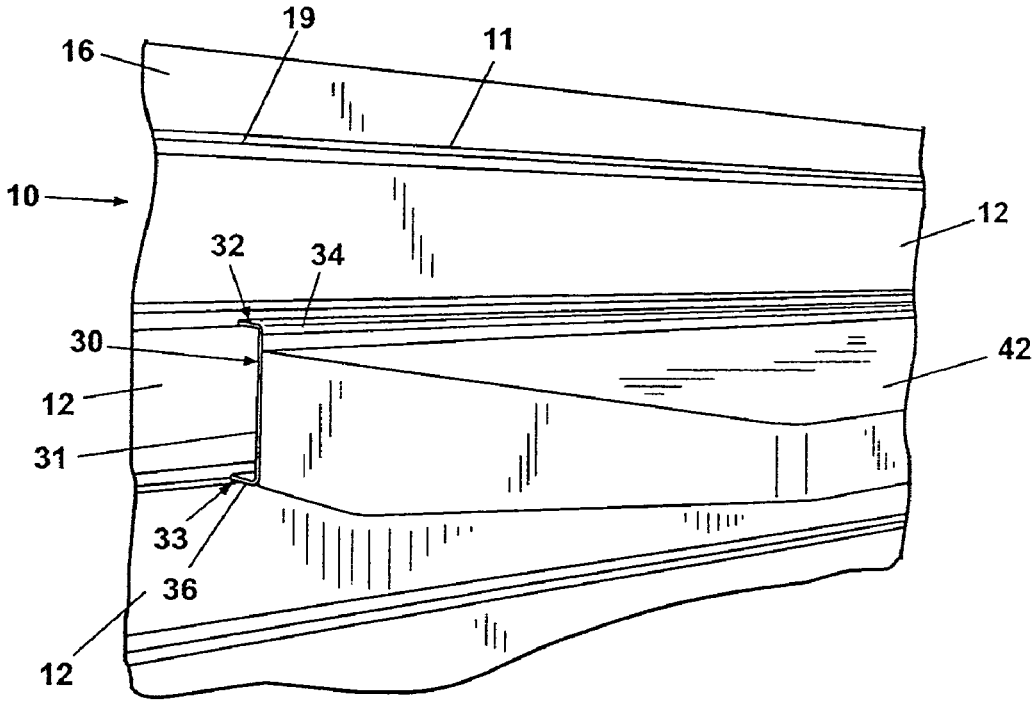
FIG. 14 is a partial perspective view of a shelf mounted on a slotwall panel with a cabinet bracket.

Referring to FIG. 14, a cabinet bracket 30 can be attached to a shelf 42 to support shelf 42 on slotwall panels 10. In the embodiment shown in FIG. 14, a cabinet bracket 30 can be attached to shelf 42 using threaded fasteners as used in connection with the cabinet as described above, or permanently attached to shelf 42 by welding. Shelf 42 can be mounted on slotwall panel 10 by inserting "J" shaped hooks 32 and 33 into adjoining slots 11 and sliding shelf 42 and cabinet bracket 30 down over adjoining slat edges 13.

As one of skill in the art should recognize, hanger brackets 20 can be combined to support a basket (not shown) on slotwall panels 10. In the embodiment, two hanger brackets 20 can be attached to a basket by welding or by any other known connection mechanism. The basket can be mounted on a slotwall panel in the same manner as a single hanger bracket as described above in detail.

Figure 15:
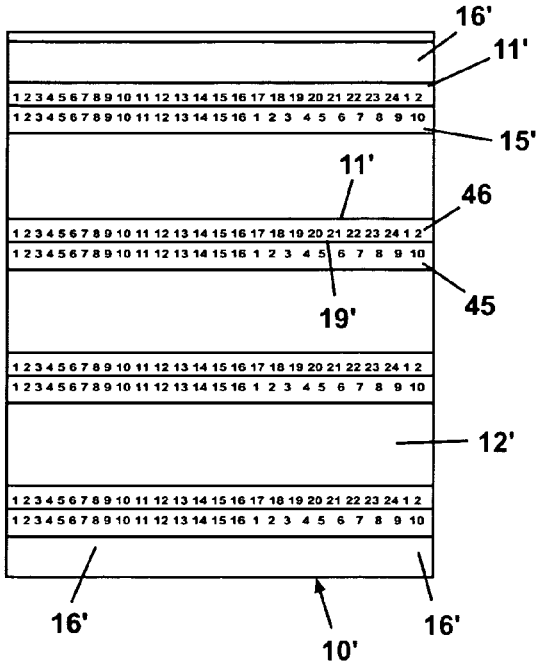
FIG. 15 is a front view of another embodiment of slotwall panel having ruler markings in the generally "T" shaped slots.
Figure 16:
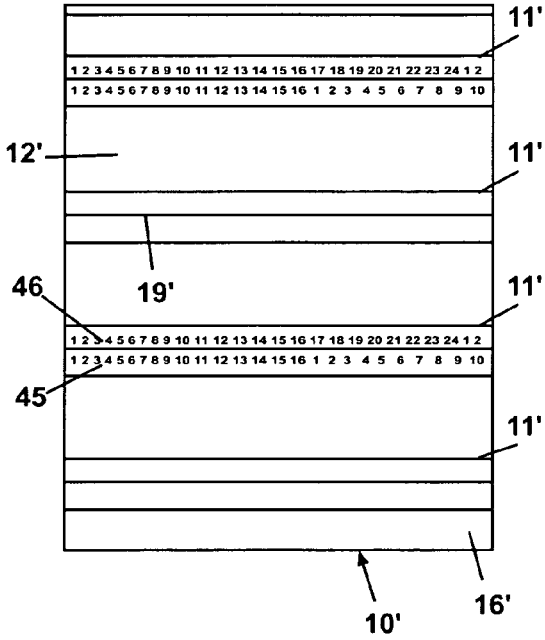
FIG. 16 is a front view of another embodiment of a slotwall panel having a different arrangement of ruler markings in the generally "T" shaped slots.

Referring to FIG. 15 and FIG. 16, another embodiment of a slotwall panel 10' is shown. In the embodiment of FIG. 15 and FIG. 16, repeating ruler markings 45 and 46 can be provided on the bottom wall 15 of generally "T" shaped slot 11 on either side of groove 19'. Ruler markings 45 can be repeating 1–16 inch marks while ruler markings 46 can be repeating 1–24 inch marks. Repeating ruler markings can facilitate mounting of slotwall panels on conventional stud wall construction. Once a stud is located for a mounting screw, adjacent screws can be inserted at the same number in the repeating sequence as the first screw since most stud walls are built on 16 inch or 24 inch centers. The provision of the repeating markings eliminates the need to measure and mark the location of subsequent studs for mounting screws once the first mounting screw is driven into a stud. As shown in FIG. 16, the repeating markings can be provided in alternate generally "T" shaped slots 11. Those skilled in the art will recognize that other patterns of repeating markings could be used such as in one generally "T" shaped slot per slotwall panel 10.

Referring to FIG. 17, another embodiment of slotwall panel is shown. The slotwall panel 10" can be fabricated of metal such as extruded aluminum. The slotwall panel 10" of the embodiment shown in FIG. 17 can have dimensions a ", b "and d" corresponding to the same dimensions in slotwall panel 10, as shown in FIG. 4. The slotwall panel 10" can support hanger brackets 20 and cabinet brackets 30 in the same manner as described above even though the thickness e of slat 12" is less than the thickness e of slat 12. As shown in FIG. 17 a groove 49 can be provided in the center of slat 12". The provision of a slat groove 49 will make the appearance of slats 12" the same as a joint between adjoining slotwall panels 10" where adjoining half slats 16" meet. Those skilled in the art will recognize that a groove 49 can be provided in slat 12 of the embodiment of the slotwall panel 10 shown in FIG. 4–FIG. 4E to provide the same function as in the embodiment of FIG. 17.

Referring to FIG. 18 and FIG. 18A, other embodiments of the slotwall panel are shown. In FIG. 18, slotwall panel 10''' can have a connecting rib 17' and connecting groove 18' that are offset toward half slat 16''' instead of offset toward the opposite surface of the slotwall panel as in the embodiment shown in FIG. 4–FIG. 4E. In FIG. 18A, slotwall panel 10'''' can have a connecting rib 17" and connecting groove 18" that are centered in slotwall panel 10''''. Those skilled in the art will understand that the connecting rib and connecting groove can have a configuration other than as shown in FIG. 4–FIG. 4E and FIG. 18 and FIG. 18A. Such other rib and connecting groove configurations could include semicircular, triangular, trapezoidal or other shapes. The rib and connecting groove configuration could also be interlocking with one panel hooking into and interlocking with an adjacent panel.

The material used to form slotwall panels 10 can be extruded foamed CPVC/PVC material as disclosed in copending patent application Ser. No. 10/747,421 mentioned above. Alternately, slotwall panels can be extruded of foamed PVC material as is known in the art. Slotwall panels can also be formed of wood panels by removing material to form the generally "T" shaped slots which in turn form the generally "T" shaped slats. Particle board material could be used to form the slotwall panels instead of wood or extruded foamed PVC material. Particle board slotwall panels could be formed by removing material to form generally "T" shaped slots. Alternately, particle board slotwall panels could be formed by attaching generally "T" shaped slats to a particle board. Plywood slotwall panels could be formed by removing material to form generally "T" shaped slots or by attaching generally "T" shaped slats as in the case of particle board.

While the invention has been specifically described in connection with certain specific embodiments thereof, it is to be understood that this is by way of illustration and not of limitation, and the scope of the appended claims should be construed as broadly as the prior art will permit.

We claim:

1. A slotwall panel storage system comprising:

a slotwall panel having a plurality of generally "T" shaped slots forming a plurality of generally "T" shaped slats having a face and having edges defined by said "T" shaped slots, said "T" shaped slots having a bottom wall generally parallel to and spaced inwardly from the face of said "T" shaped slats; and one or more brackets for removably mounting a device on said slotwall panel, said brackets comprising:

a support portion arranged to attach a device to said brackets;

a first "J" shaped hook on one edge of said support portion opening in a first direction to hook into a first adjoining "T" shaped slot and over an edge of a slat; and a second "J" shaped hook on an opposite edge of said support portion and opening in said first direction to hook into a second adjoining "T" shaped slot and behind an adjacent slat;

wherein said first and second "J" shaped hooks can be simultaneously inserted into the first and second adjoining "J" shaped slots on said slotwall panel without pivoting said one or more brackets.

2. The slotwall panel storage system of claim 1, wherein each of the first and second adjoining "T" shaped slots comprises an opening that is larger than said first and second "J" shaped hooks so that said one or more brackets can be mounted to said slotwall panel by inserting said first and second "J" shaped hooks into the first and second adjoining "T" shaped slots.

3. The slotwall panel storage system of claim 2 wherein each of said first and second "J" shaped hooks have a first leg extending in a direction generally perpendicular from the edge of said support portion and a second leg extending from said first leg in the first direction generally parallel to said support portion.

4. The slotwall panel storage system of claim 2 wherein a plurality of brackets are attached to a device to support the device on said slotwall panel and at least two of said plurality of brackets are horizontally spaced on said device for engaging the same slats.

5. The slotwall panel storage system of claim 2 wherein a plurality of brackets are attached to a device to support the device on said slotwall panel and at least two of said plurality of brackets are vertically spaced on said device.

6. The slotwall panel storage system of claim 5 wherein said device includes a housing, said plurality of brackets are attached to said housing with bolts, and said plurality of brackets extend a substantial portion of the width of said housing.

7. The slotwall panel storage of claim 6 wherein at least one of the plurality of brackets is attached to the housing in a fixed position on said housing.

8. The slotwall panel storage system of claim 7 wherein another of the plurality of brackets is adjustably attached to said housing such that the first "J" shaped hook of said another of the plurality of brackets can be adjusted relative to the housing to thereby rest on the slat.

9. The slotwall panel storage system of claim 6 wherein each of said plurality of brackets is attached to said housing with at least two bolts.

10. The slotwall panel storage system of claim 1 wherein said slotwall panel is foamed plastic material.

11. The slotwall panel storage system of claim 10 wherein said slotwall panel is extruded foamed material including polyvinyl chloride.

12. The slotwall panel storage system of claim 1 wherein said slotwall panel is wood with said "T" shaped slots formed by removing material to form said "T" shaped slats.

13. The slotwall panel storage system of claim 1 wherein said slotwall panel is a wood base with said "T" shaped slots formed by attaching "T" shaped wood slats to the wood base.

14. The slotwall panel storage system of claim 1 wherein said slotwall panel is particle board with said "T" shaped slots formed by removing material to form said "T" shaped slats.

15. The slotwall panel storage system of claim 1 wherein said slotwall panel is a particle board base with said "T" shaped slots formed by attaching "T" shaped slats to the particle board base.

16. The slotwall panel storage system of claim 1 wherein said slotwall panel is plywood with said "T" shaped slots formed by removing material to form said "T" shaped slats.

17. The slotwall panel storage system of claim 1 wherein said slotwall panel is a plywood base with said "T" shaped slots formed by attaching "T" shaped slats to the plywood base.

18. The slotwall panel storage system of claim 1 wherein said slotwall panel is extruded aluminum.

* * * * *